US005645207A

United States Patent [19]

Young, Jr. et al.

[11] Patent Number: 5,645,207

[45] Date of Patent: Jul. 8, 1997

[54] APPARATUS AND METHOD FOR SECURING A MOVING FABRIC

[75] Inventors: William O. Young, Jr., Spartanburg; Ebun Surka, Moore; George Lark, Spartanburg, all of S.C.

[73] Assignee: Young Engineering, Inc., Spartanburg, S.C.

[21] Appl. No.: 497,840

[22] Filed: Jul. 3, 1995

[51] Int. Cl.[6] ..... B23Q 15/06; B65H 26/02; B65H 43/08

[52] U.S. Cl. ..... 226/1; 226/17; 226/20; 226/21

[58] Field of Search ..... 226/17, 18, 20, 226/21, 1

[56] References Cited

U.S. PATENT DOCUMENTS

| | | | |
|---|---|---|---|
| 12,771 | 4/1855 | Hawes . | |
| 88,505 | 3/1869 | Palmer . | |
| 459,203 | 9/1891 | Hollingworth . | |
| 1,697,828 | 1/1929 | Cunniff . | |
| 1,773,232 | 8/1930 | Lenders . | |
| 1,880,487 | 10/1932 | Richardson . | |
| 2,402,074 | 6/1946 | Nield . | |
| 2,907,195 | 10/1959 | Schoenster et al. . | |
| 2,916,899 | 12/1959 | Hepp et al. . | |
| 3,031,732 | 5/1962 | Carlisle . | |
| 3,096,919 | 7/1963 | Snyder . | |
| 3,108,727 | 10/1963 | Farber . | |
| 3,160,340 | 12/1964 | Menkel . | |
| 3,244,418 | 4/1966 | Henderson . | |
| 3,366,876 | 1/1968 | Kurth et al. | 226/18 |
| 3,568,904 | 3/1971 | Kurz . | |
| 3,752,377 | 8/1973 | Knapp | 226/17 |
| 3,786,974 | 1/1974 | Kron . | |
| 3,885,600 | 5/1975 | Altmann . | |
| 3,900,141 | 8/1975 | Duckworth . | |
| 3,912,193 | 10/1975 | Calvaer . | |
| 3,936,915 | 2/1976 | Becker . | |
| 3,949,281 | 4/1976 | Young, Jr. . | |
| 4,068,789 | 1/1978 | Young, Jr. et al. . | |
| 4,146,797 | 3/1979 | Nakagawa . | |
| 4,217,682 | 8/1980 | Young, Jr. et al. . | |
| 4,322,026 | 3/1982 | Young, Jr. . | |
| 4,392,910 | 7/1983 | Tokuno et al. | 226/20 |
| 4,447,937 | 5/1984 | Young, Jr. . | |
| 4,494,740 | 1/1985 | Noboru et al. . | |
| 4,578,845 | 4/1986 | Young, Jr. . | |
| 4,700,642 | 10/1987 | Hankinson, Jr. . | |
| 4,728,800 | 3/1988 | Surka . | |
| 4,817,254 | 4/1989 | Poterala . | |
| 4,829,918 | 5/1989 | Young, Jr. . | |
| 4,991,761 | 2/1991 | Gnuechtel et al. . | |
| 5,042,121 | 8/1991 | Young, Jr. . | |

(List continued on next page.)

FOREIGN PATENT DOCUMENTS

| | | | |
|---|---|---|---|
| 410859 | 5/1934 | United Kingdom | 226/20 |

*Primary Examiner*—Daniel P. Stodola
*Assistant Examiner*—Matthew A. Kaness
*Attorney, Agent, or Firm*—Dority & Manning, P.A.

[57] ABSTRACT

An improved apparatus for handling a moving material of indeterminate length utilizes a pair of endless elements located on opposite sides of an intended path of travel for the moving material. Each element is configured to engage and hold a corresponding edge of the material at least partially through the apparatus. The apparatus includes a detector assembly adjacent the path of travel for detecting deviation of at least one edge of the moving material from a normal operating path and outputting signals to initiate corrective reaction to the deviation. The reaction is defined in a predetermined relationship to time the edge remains out of its normal operating path. The apparatus also includes an adjustment device in operative communication with at least one frame member and the detector assembly. The adjustment device receives the corrective signals and positionally adjusts the corresponding frame member in response thereto to achieve the normal operating path. The apparatus may be configured to adjust the frame member at an emergency reaction upon gross deviation of the edge from the normal operating path.

24 Claims, 5 Drawing Sheets

U.S. PATENT DOCUMENTS 5,067,646 11/1991 Young, Jr. et al. .
5,119,981 6/1992 Gnuechtel et al. ..... 226/18
5,126,946 6/1992 Ko ..... 226/18
5,252,991 10/1993 Storlie et al. ..... 226/20
5,255,419 10/1993 Stanislaw et al. .
5,320,267 6/1994 Oono et al. .
5,328,072 7/1994 Ruessmann et al. .
5,373,613 12/1994 Young, Jr. et al. ..... 26/96

APPARATUS AND METHOD FOR SECURING A MOVING FABRIC

BACKGROUND OF THE INVENTION

The invention relates to method and apparatus for controlling moving material and the like, and, more particularly, to improved method and apparatus for achieving a normal operating path of material edges during movement of the material in a desired path of travel.

It is a common practice in manufacturing operations involving indefinite lengths of materials such as fabrics to transport the fabric in a desired path of travel for processing and/or collection. Typically, in textile manufacturing operations, textile fabrics in indefinite length form are longitudinally moved in a path of travel for treatment, inspection, and/or collection in roll form. In such operations, it is generally desirable that the fabric be secured close to its edges for effective processing and minimization of waste.

In the general operation of tenter frames, for example, fabric enters the machine at one end where it is engaged along its edges, or selvages, by a series of upwardly extending pins which penetrate the fabric material. The pins are, in turn, secured to and supported by two endless tenter chains. The fabric is thus held along its opposite edges by the upwardly extending pins for the full period of travel through the tenter frame where it may be subjected to various treatments, for example washing, drying, and dyeing.

Typically, tenter frames transversely maintain the fabric as it moves longitudinally through its path of travel. The selvages are typically reenforced to prevent the fabric edges from tearing where they are secured by the pins.

It is also desirable to secure the fabric at the selvages to reduce waste, since the selvage areas must often be trimmed from the finished fabric. One difficulty with consistently pinning the fabric at the selvages is that the fabric may transversely shift as it enters the machine. Additionally, a fabric edge itself may be uneven. If the tenter frame fails to pin an area of the fabric, a gap is produced, particularly when the fabric is stretched downstream. These gaps must be cut out from the finished material, causing waste, inefficient product handling, and possibly machine down time.

Thus, while on one hand it is desirable to pin the fabric as close to the edge as possible to prevent trimming waste, it is on the other hand desirable to ensure pinning of the fabric to avoid defects inherent from mispinning.

Accordingly, the two tenter frame endless chains are typically at least partially supported on corresponding frame members that are transversely adjustable with respect to the path of travel of the moving fabric. These frame members may be adjusted according to the variation of the fabric edge, attempting to secure the fabric near its edges while avoiding mispins.

To control the transverse adjustment of these frame members, it is known to monitor the transverse position of the edges upstream from the point at which they are secured by the frame members and to adjust the frame members to compensate for position variations. Typical control systems employ photosensor devices configured to detect the presence or absence of a corresponding fabric edge.

One difficulty arising from the use of such systems results from color variation of fabrics often run on tenter frames. Color effects may be such that a control system might react too slowly, or not at all, when fabrics of certain colors are run on the tenter frame. Thus, for example, a tenter frame may tend to pin a lighter color fabric nearer its edge than a darker color.

One method of alleviating such problems associated with fabric color is to adjust the intensity of light emitted by the photosensor light source according to fabric color. Such a practice may be inefficient if such adjustments are frequently required. Additionally, light intensity increases may cause control system malfunctions due to reflections from background objects.

Another difficulty encountered with such control systems is that dust and fabric particles frequently collect on photosensor surfaces. This may inhibit photosensor operation and decrease the control system's effectiveness.

Furthermore, typical fabric edges are relatively uneven and may have strings and other abnormalities. Typical tenter frame control devices attempt to adjust the frame members according to the position of the edge. The edge variations may cause unnecessary and overly frequent frame member adjustment.

Furthermore, control systems generally adjust the speed at which corrections are made to frame member position according to the distance the edge deviates from a desired position. Such systems typically vary the correction speed proportionally to the position of the edge within the detection area of one or more photosensors. For example, frame member correction speed may increase as the fabric edge moves across the detection area. Greater speed variation may be achieved by adding photosensors on either side of the fabric edge desired position.

Such control systems may not react fast enough in response to gross fabric edge deviations. Gross deviations are substantial deviations of the fabric edge, most often in the inward direction. They may be caused by tears, particularly at seams, that require a relatively fast response of the frame to avoid a mispin. If the control system is configured to increase speed quickly as the fabric edge moves away from the desired position, the frame member may also move quickly as the edge returns, potentially causing the frame member to overshoot the desired position.

SUMMARY OF THE INVENTION

The present invention recognizes and addresses the foregoing disadvantages and others of prior art construction and methods.

Accordingly, it is an object of the present invention to provide an apparatus and method for effectively controlling moving material and the like.

Some of these objects are achieved by an apparatus for handling a moving material of indeterminate length. The apparatus comprises a means for moving the material in an intended path of travel. The apparatus also comprises a detector assembly adjacent the path of travel for detecting deviation of at least one edge of the moving material from a corresponding normal operating path and initiating corrective reaction to the deviation to achieve the normal operating path. The reaction is defined in a predetermined relationship to the time the edge remains out of the normal operating path. The apparatus also comprises at least one adjustment device in operative communication with the detector assembly. The adjustment device adjusts the moving means in response to the detector assembly.

In one presently preferred embodiment, the detector assembly is configured to recognize a material edge when the light intensity received by a photosensor receiver reaches a predetermined level. This predetermined level in turn corresponds to a certain transverse position of the material edge beneath the detector assembly.

In another presently preferred embodiment, a detector assembly includes a control photosensor configured to detect edge deviation from a normal operating line and an emergency photosensor located at a predetermined position inward from the control photosensor to detect gross edge deviation at an emergency line inward from the normal operating line. The detector assembly includes digital circuitry in communication with the control and emergency photosensors that outputs appropriate corrective signals responsively to the relationship between the edge and these lines. The detector assembly in one preferred embodiment includes a microprocessor.

The normal operating line is within a normal operating path for the material edge. The emergency line is inward from that line. That is, it is parallel to the normal operating line between the normal operating line and the center line of the moving material.

The emergency photosensor is utilized in this embodiment to react to gross inward deviations where the edge of the moving material may not be pinned, clipped, or the like. When a deviation crossing the emergency line is detected, the detector assembly outputs corrective signals to the adjustment device causing the adjustment device to move the frame member inward at a relatively high emergency speed to pin or otherwise secure the edge at that inward deviation. In this presently preferred embodiment, the frame member is moved inward at the emergency speed as long as the emergency photosensor remains "uncovered," that is, as long as the material edge remains inward of the emergency line.

When the edge moves outward of the emergency line, or upon startup of the apparatus, the adjustment device positionally adjusts the frame member at a predetermined speed variation from startup or from the emergency speed to enable the pins to secure the edge and to achieve the normal operating path.

Once the emergency photosensor is covered, or if at startup the emergency photosensor is covered, the adjustment device adjusts the frame member inward or outward at predetermined speeds within predetermined time periods, depending on the position of the edge with respect the normal operating line. The speeds and the time periods thereof are set so that a normal operating path may be achieved from the starting position of the edge. The speeds generally decrease over time and may permit oscillation of the edge over the normal operating line until the normal operating path is initiated.

The speed pattern occurs for a predetermined overall time period set to ensure that a generally uniform edge may reach the normal operating path regardless of its starting position.

It should be understood that positional adjustments may be made either to the frame member or to the moving material to achieve the normal operating path. For example, various apparatus are known for positioning and/or moving a material on a processing machine. One such apparatus is disclosed in U.S. Pat. No. 4,068,789, the disclosure of which is incorporated by reference herein. It should therefore be understood that the adjustment device may be configured to adjust the transverse position of the moving material in conjunction with such a device. Accordingly, the apparatus may adjust the relationship between the edge and the normal operating path in various equivalent manners. Thus, it should be understood that descriptions herein referring to the edge as "achieving" the normal operating path may generally refer to the change in relationship between the edge and the normal operating path, unless otherwise indicated. Furthermore, the apparatus of the present invention may be employed in conjunction with various materials such as films or textile webs and various means for moving such materials, such as rolls and pinned endless chains.

In another presently preferred embodiment, the detector device is configured with the adjustment device to maintain the position of the frame member when the edge remains at the normal operating path. As discussed above, the edge is typically uneven and may contain relatively extreme, but brief, deviations such as strings. The edge nevertheless remains at the normal operating path as long as it varies over, within, or about the normal operating path within a predetermined time period. In this embodiment, the normal operating line is a benchmark for determining such variations.

If the edge deviates from the normal operating line longer than the predetermined time limit, the adjustment device moves the frame member in the appropriate direction at a predetermined speed. If the edge does not cross the normal operating line within a predetermined time, the speed is increased. Any number of stepped increases may be provided.

One presently preferred embodiment of the method according to the present invention for handling a material of indeterminate length comprises the steps of moving the material at least partially through a material handling apparatus along an intended path of travel, detecting deviation of at least one edge of the moving material from a corresponding normal operating path, and initiating corrective reaction of the material handling apparatus when the at least one edge is determined to be outside its normal operating path, the corrective reaction being of a predetermined speed with predetermined speed changes effectuated upon time lapsed from the initiation of the corrective reaction.

The accompanying drawings, which are incorporated and constitute a part of this specification, illustrate one embodiment of the invention and, together with the description, serve to explain the principles of the invention.

BRIEF DESCRIPTION OF THE DRAWINGS

A full and enabling disclosure of the present invention, including the best mode thereof, directed to one of ordinary skill in the art is set forth in the specification, the remainder of which makes reference to the appended drawings in which.

Figures 1, 1A:
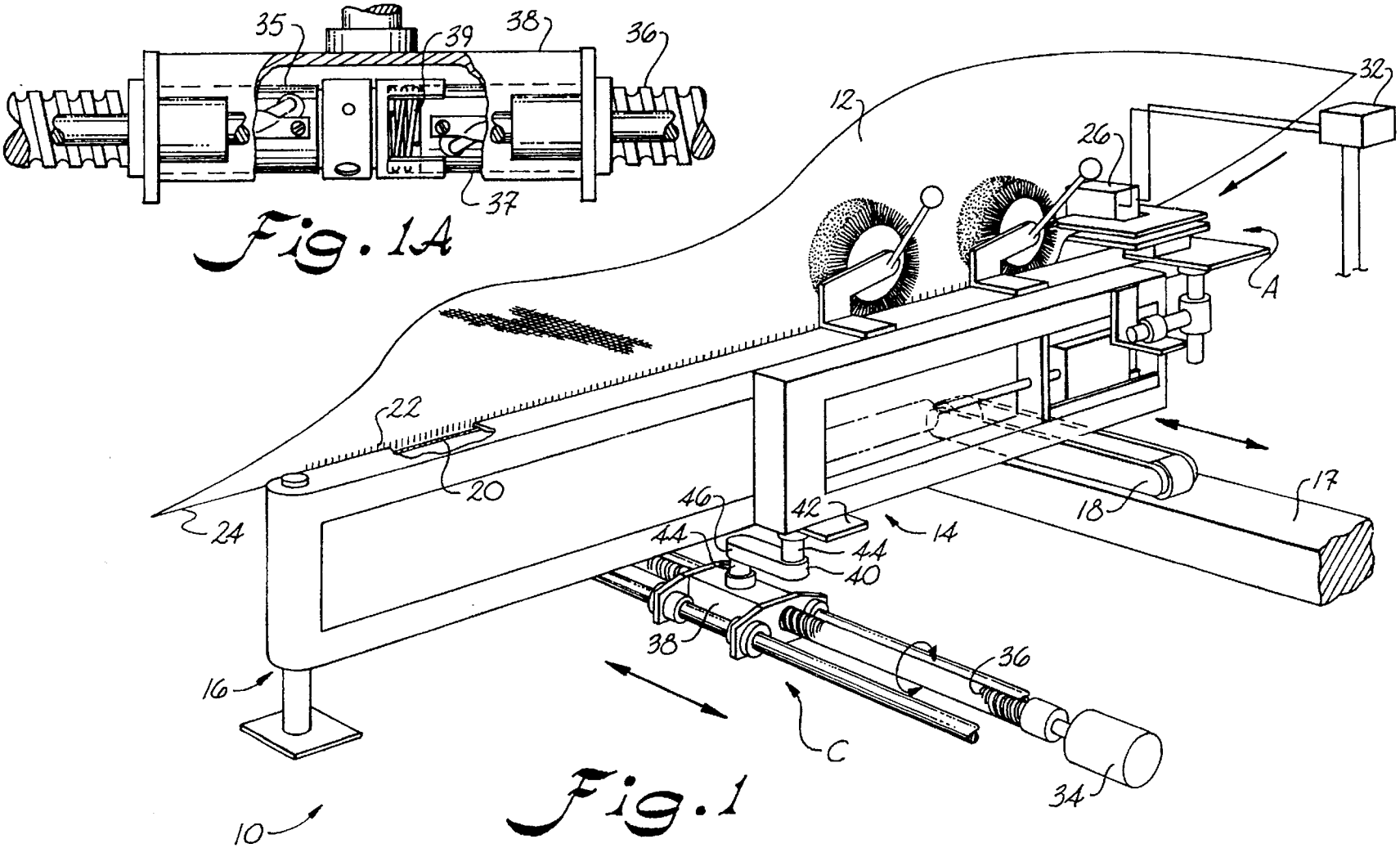
FIG. 1 is a partial perspective view of a tenter frame constructed in accordance with the present invention.
FIG. 1A is a cross-sectional view of a carrier device for use with the tenter frame as in FIG. 1.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations as come within the scope of the appended claims and their equivalents.

The present invention is concerned with an apparatus and method for controlling a moving material and the like. Accordingly, FIG. 1 depicts a presently preferred embodiment of a tenter frame, shown generally at 10, for spreading and transporting open widths of a moving fabric 12. The tenter frame includes a pair of frame devices configured to transport moving fabric 12. One frame member is indicated generally at 14. Frame member 14 is pivotally joined at 16 to the main body (not shown) of tenter frame 10. Frame member 14 is supported at its opposite end by cross member 17 on roller carriage 18. Roller carriage 18 is configured to move along cross member 17 as indicated. Thus, frame member 14 is transversely adjustable with respect to fabric 12 about pivotal connection 16.

Frame member 14 at least partially supports an endless chain 20. Endless chain 20 has a plurality of pins 22 for engaging a longitudinal edge 24 of fabric 12. U.S. Pat. Nos. 5,373,613 and 5,042,121 generally describe the operation of a tenter frame, particularly with regard to pinning fabric edges. The disclosures of these patents are incorporated by reference herein.

Fabric 12 enters tenter frame 10 at front end A in the direction indicated. Tenter frame 10 also includes a control device associated with each frame member 14 for adjusting the transverse position of frame member 14 in response to movements of fabric 12 or variations in edge 24 so that edge 24 may be effectively pinned by pins 22.

Figure 5:
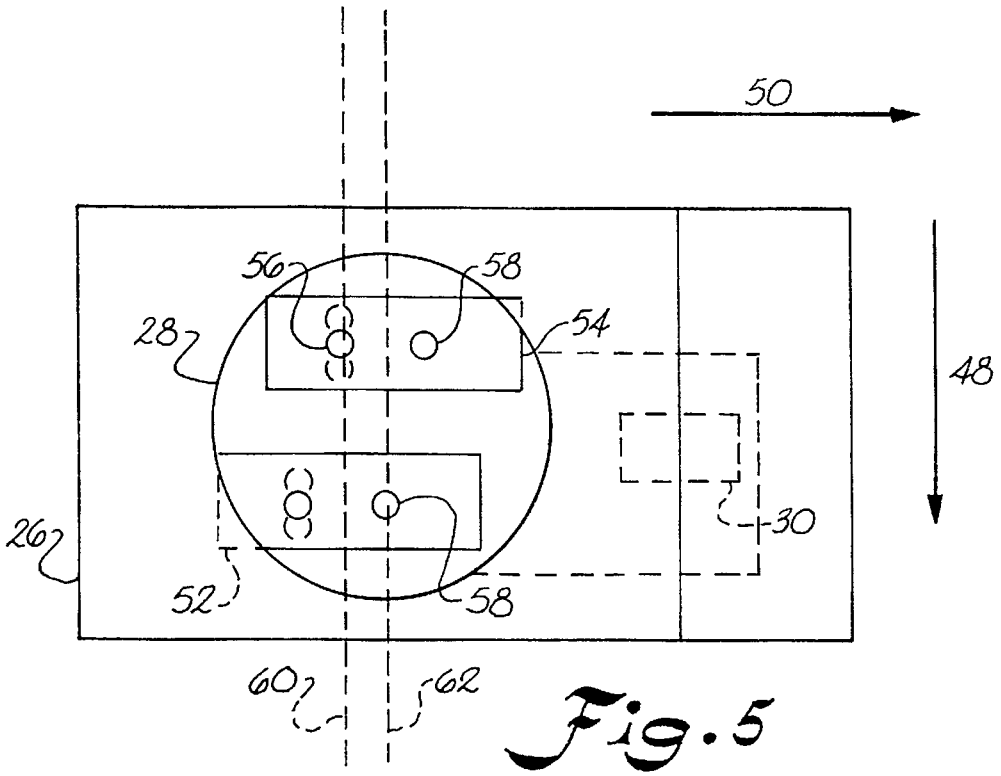
FIG. 5 is a partial bottom view of a control device constructed according to the present invention.
Figure 6:
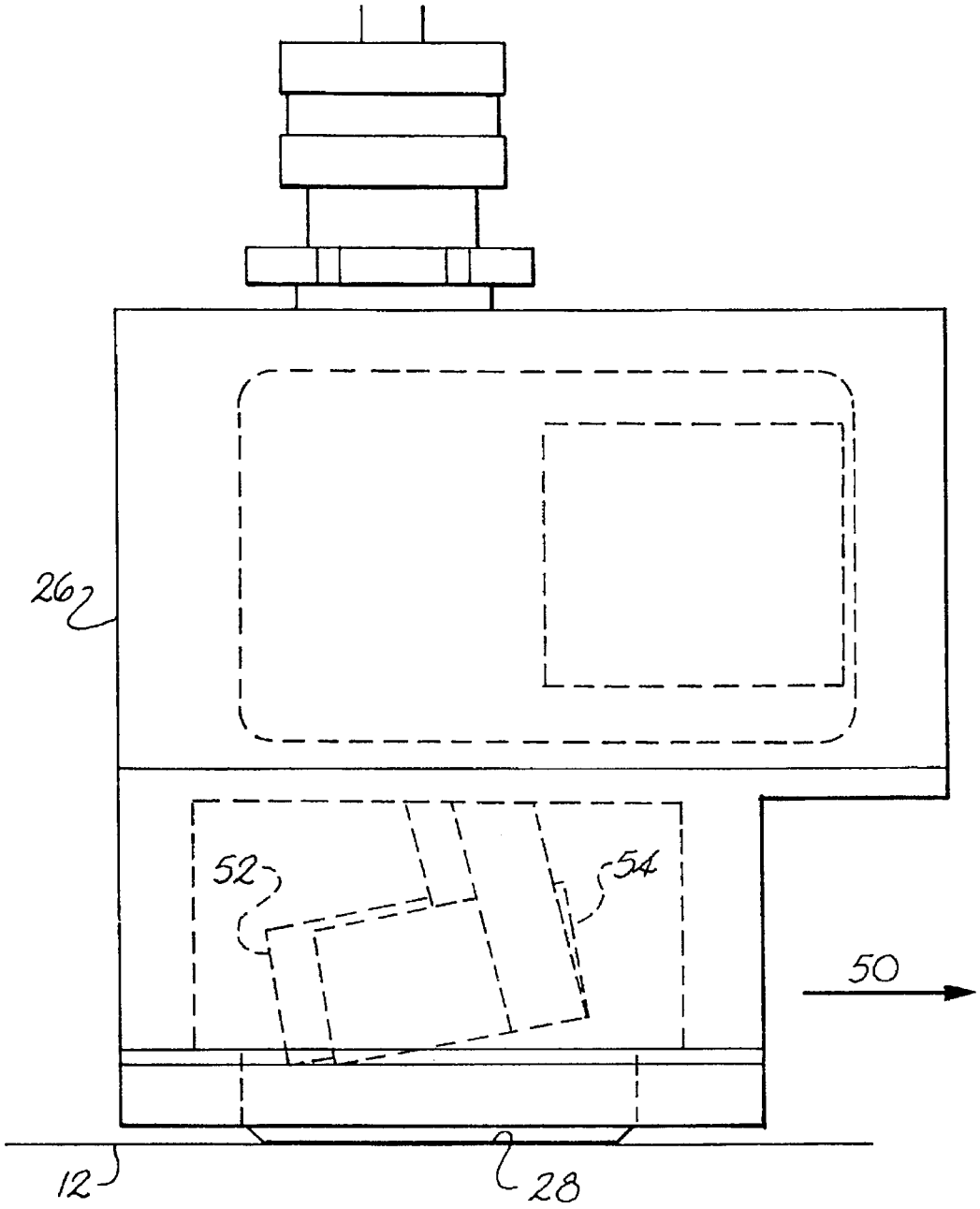
FIG. 6 is a partial side view of a control device as in FIG. 5.

The control device includes at least one detector assembly 26 proximate moving fabric 12 configured to monitor fabric edge 24. Detector assembly 26 may thus detect deviation of edge 24 from a normal operating path. As shown in FIG. 5, detector assembly 26 has a transparent front face 28. Referring to FIG. 6, front face 28 of detector assembly 26 abuts moving fabric 12.

Detector assembly 26 also includes a microprocessor, shown in FIG. 5 in phantom at 30, configured to receive detection signals from detectors housed in detector assembly 26 and to output signals corresponding to corrective reactions to edge deviation from a normal operating path. The corrective signals here initiate adjustment of frame member 14 at predetermined speeds.

It should be understood by those of ordinary skill in the art that various configurations of detector assembly 26 are possible. For example, microprocessor 30, or any equivalent device capable of executing predetermined arithmetic or logic functions, may be remotely located from photosensors housed by the assembly. Furthermore, digital or analog circuitry may be employed to perform equivalent functions of microprocessor 30.

It should also be understood by those of ordinary skill in the art that photosensor detectors may sometimes be affected by fabric color and that it is sometimes necessary when using such detectors to vary the light intensity of the detectors as fabrics of various colors are run on the apparatus. Such intensity variations may cause undesirable background reflections. Applicant has found that the use of a triangulation background suppression sensor reduces such difficulties.

The control device also includes an adjustment device C in operative communication with frame member 14 and detector assembly 26. Adjustment device C is configured to receive corrective signals from microprocessor 30 and to positionally adjust frame member 14 in response thereto to achieve the normal operating path.

The control device also includes interface device 32 that includes an amplifier for amplifying the output of microprocessor 30 to a level acceptable to adjustment device C.

Motor 34 drives a motive assembly that includes a ball screw assembly. The ball screw assembly includes threaded rod 36, carrier 38, and self-aligning linkage 40 connected to frame member 14 by plate 42.

Motor 34 receives corrective signals from detector assembly 26 through interface 32 and drives threaded rod 36 responsively thereto. Depending on the rotation of threaded rod 36, carrier 38 moves in either transverse direction with respect to fabric 12 as indicated. In a presently preferred embodiment, threaded rod 36 and carrier 38 are surrounded by a housing (not shown) having a movable strip at the top thereof configured to permit the movement of linkage 40 in conjunction with carrier 38. For purposes of clarity, the housing is not shown.

An interior view of carrier 38 is provided in FIG. 1A. Ball nuts 35 and 37 receive threaded rod 36. Spring 39 exerts pressure against nuts 35 and 37. As should be understood by those of ordinary skill in the art, such an anti-backlash configuration substantially prevents jolts in carrier 38 when threaded rod 36 starts and stops rotating. This permits adjustment device C to more precisely respond to detector assembly 26.

Referring again to FIG. 1, self-aligning linkage 40 includes two vertical posts 44 and a horizontal member 46. Adjustment device 60 is thus configured to transversely adjust the position of frame member 14 to effectively pin fabric edge 24 downstream from photosensor assembly 26.

Tenter frame 10 includes two endless chains 20, frame members 14, and control devices on either side of fabric 12. The configuration on either side operates independently of the other. Thus, for example, the apparatus may accommodate edge deviations as well lateral shifts of fabric 12.

Figure 4:
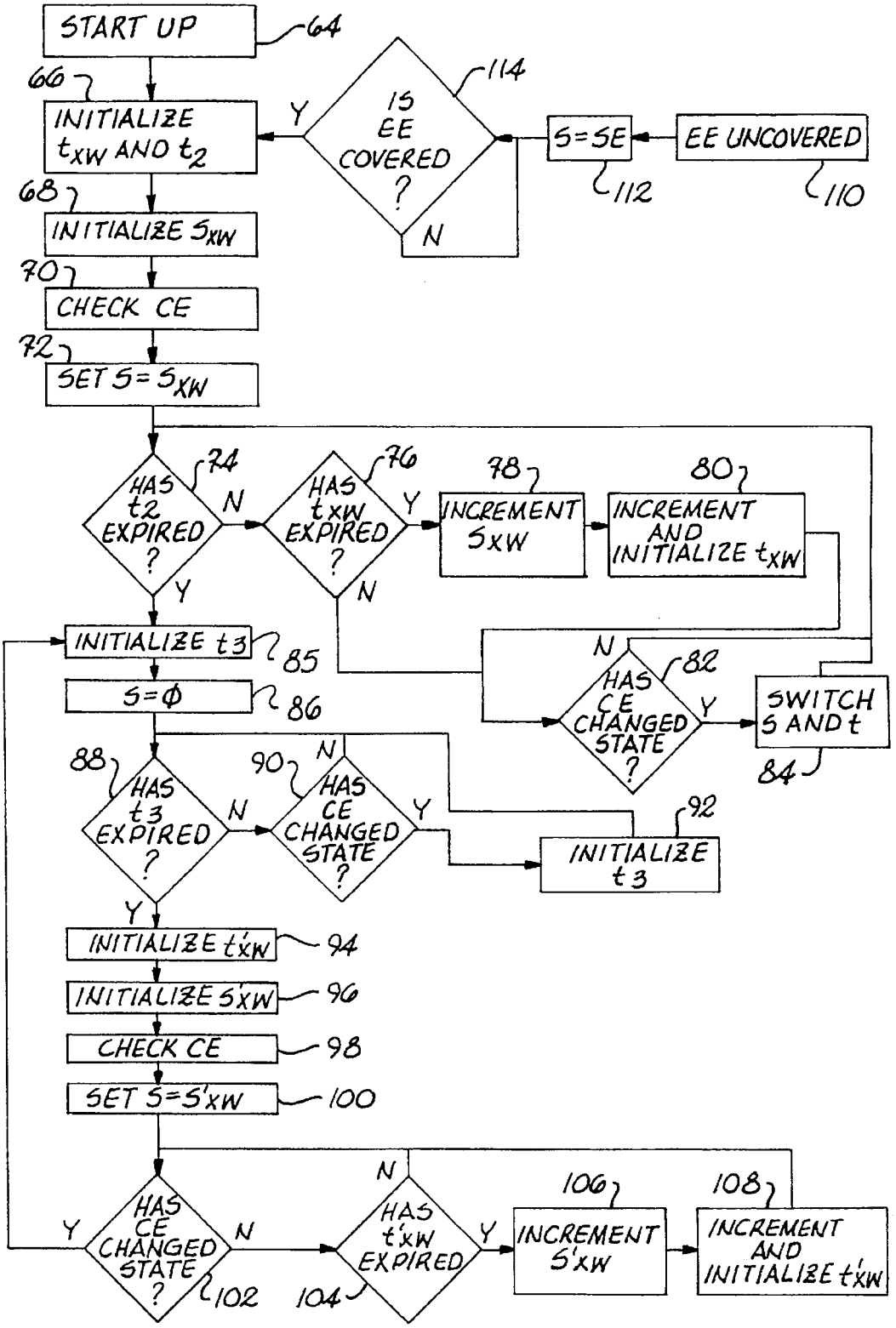
FIG. 4 is a diagrammatic illustration of one embodiment of the method according to the present invention.

A functional illustration of one embodiment of the method of the invention is provided in FIG. 4. The steps of FIG. 4 may be, for example, embodied within a program performed by microprocessor 30. It should be understood that the illustration of FIG. 4 is provided by way of example only and not by way of limitation. For example, various equivalent functions, programs, circuitry and the like are encompassed by the scope and spirit of the present invention.

Referring now to FIG. 5, a bottom view of detector assembly 26 is provided. Fabric flow is indicated at 48. Inward direction 50 indicates the position of the center line of fabric 12 with respect to detector assembly 26.

Detector assembly 26 includes a control photosensor 52 and an emergency photosensor 54. Each photosensor includes a light source 56 and a light receiver 58. A normal operating line 60 may be defined for a particular fabric generally beneath control photosensor 52, and an emergency line 62 may be defined generally beneath emergency photosensor 54.

Referring now to FIG. 4, upon tenter frame startup at 64, time variables $t_{XW}$ and $t_2$ are initialized at 66. Speed variable $S_{XW}$ is initialized at 68. An exemplary illustration of speeds $S_{XW}$ and time variables $t_{XW}$ and $t_2$ are provided in FIG. 2. It should be understood that this illustration is provided for ease of explanation only and does not constitute a limitation on the present invention. For example, first outward time period $t_{01}$ need not equal first inward time period $t_{I1}$. Similarly, the magnitude of first inward speed $S_{I1}$ need not equal the magnitude of first outward speed $S_{01}$.

Figure 2:
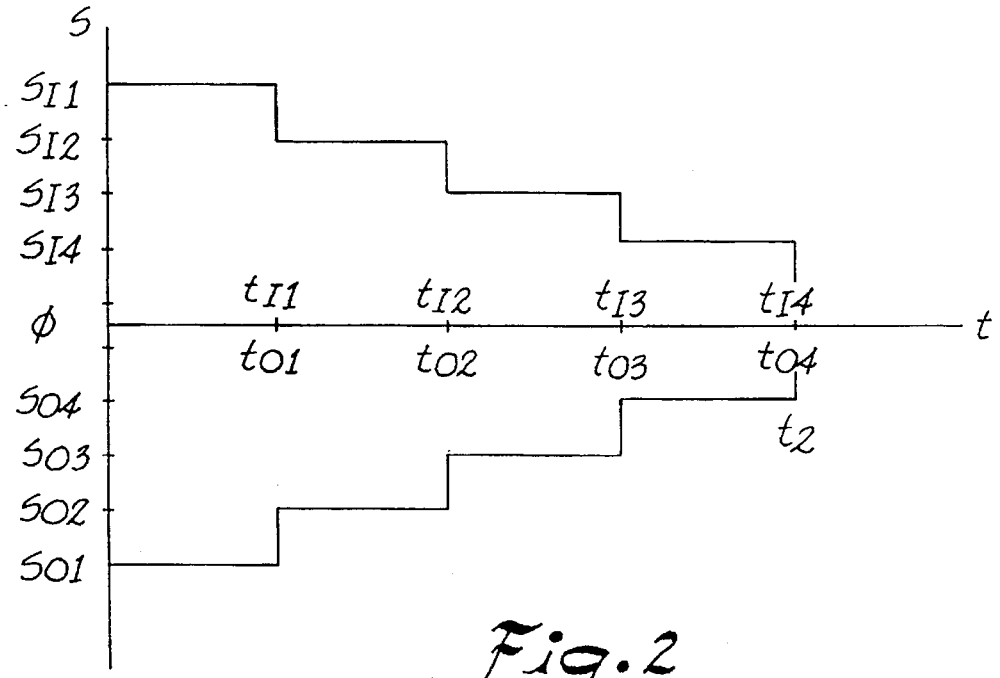
FIG. 2 is a diagram illustrating exemplary speed variations from apparatus startup or from an emergency condition.

The state of the control photosensor 52 is checked at 70. If fabric edge 24 is outward from normal operating line 60, control photosensor 52 is "covered." Frame member 14 should therefore move outward. Thus, speed S of frame member 14 is set at 72 to the first outward speed $S_{01}$. The time variation pattern of FIG. 2 is followed for the duration of time period $t_2$. Accordingly, if $t_2$ has not expired at 74, $t_{XW}$ is checked at 76. The time variable $t_{XW}$ represents the individual time periods $t_{I1}$ through $t_{I4}$ and $t_{01}$ through $t_{04}$ associated with the various speeds $S_{I1}$ through $S_{I4}$ and $S_{01}$ through $S_{04}$ illustrated in FIG. 2. Beginning at time zero, both the outward and inward timing sequences are clocked, regardless of the direction frame member 14 is actually moving. If a time period $t_{XW}$ expires at 76, the speed $S_{XW}$ is incremented to the next level at 78 and the next time variable $t_{XW}$ is initialized at 80. For example, outward speed variable $S_{OW}$ is incremented from $S_{01}$ to $S_{02}$ at the expiration of $t_{01}$ while inward speed variable $S_{IW}$ is incremented at the expiration of $t_{I1}$ from $S_{I1}$ to $S_{I2}$.

If the control photosensor 52 has not changed state (gone from "covered" to "uncovered" or vice versa), $t_2$ is again checked at 74. If the control photosensor has changed state at 82, speed S is switched at 84 from an outward to an inward speed or vice versa.

For example, again assuming that speed S begins at $S_{01}$, time periods $t_{01}$ and $t_{I1}$ are repeatedly checked at 76. If $t_{01}$ expires before control photosensor 52 changes state, speed S changes from $S_{01}$ to $S_{02}$ at 78. If $t_n$ expires before the control photosensor changes state, $S_{I1}$ will increment to $S_{I2}$ at 78 but will not affect the adjustment of frame member 14 which is running at the outward speeds.

If the control photosensor changes state before $t_{01}$ or $t_{I1}$ expire, speed S switches from $S_{01}$ to $S_{I1}$ at 84. This means that frame member 14 moved outward such that edge 24 crossed inward of normal operating line 60. Accordingly, the adjustment speed is altered so that frame member 14 moves inward. The process continues through successive speeds $S_{XW}$ and time periods $t_{XW}$ until $t_2$ expires.

Speeds $S_{XW}$ and time periods $t_{XW}$ and $t_2$ are set so that frame member 14 will start moving quickly toward a normal operating position. It should be understood that various equivalent configurations and steps may be employed to adjust frame member 14 at a predetermined speed variation from a startup or emergency condition to initiate a normal operating path. For example, a linear or geometric speed variation may be employed instead of the step variation shown in FIG. 2. Additionally, multiple control photosensors may be used.

When $t_2$ expires, fabric edge 24 and normal operating line 62 should be relatively close. To maintain a normal operating path, time period $t_3$ is initialized at 85 and frame member 14 is stopped at 86. Because typical fabric edges are uneven, the position of moving fabric edge 24 measured at a stationary point should vary. As long as control photosensor 52 detects such a variation, fabric edge 24 remains in a normal operating path and frame member 14 remains stationary.

Accordingly, the detector assembly monitors control photosensor 52 to detect state changes within time period $t_3$. $t_3$ is set depending on tenter frame speed. The speed at which the fabric edge moves over the control photosensor in part determines the rate at which the control photosensor will change state. Applicant has found that a period of 0.2 seconds is one appropriate setting for a tenter frame running at 100 yards per minute. The control device may be configured to automatically change this time period as tenter frame speed changes.

Before $t_3$ expires at 88, the control photosensor state is repetitively checked at 90. As long as the control photosensor changes state before $t_3$ expires, $t_3$ will be reinitialized at 92. Thus, as long as fabric edge 24 varies over the control photosensor within $t_3$, the normal operating path and, thus, the stationary position of frame member 14, is maintained.

The failure of control photosensor 52 to change state over time period $t_3$ indicates that fabric edge 24 has deviated from the normal operating path. The control device then generates appropriate corrective signals to adjustment device C corresponding to corrective speeds varying in a predetermined relationship to time edge 24 remains out of the normal operating path.

Figure 3A:
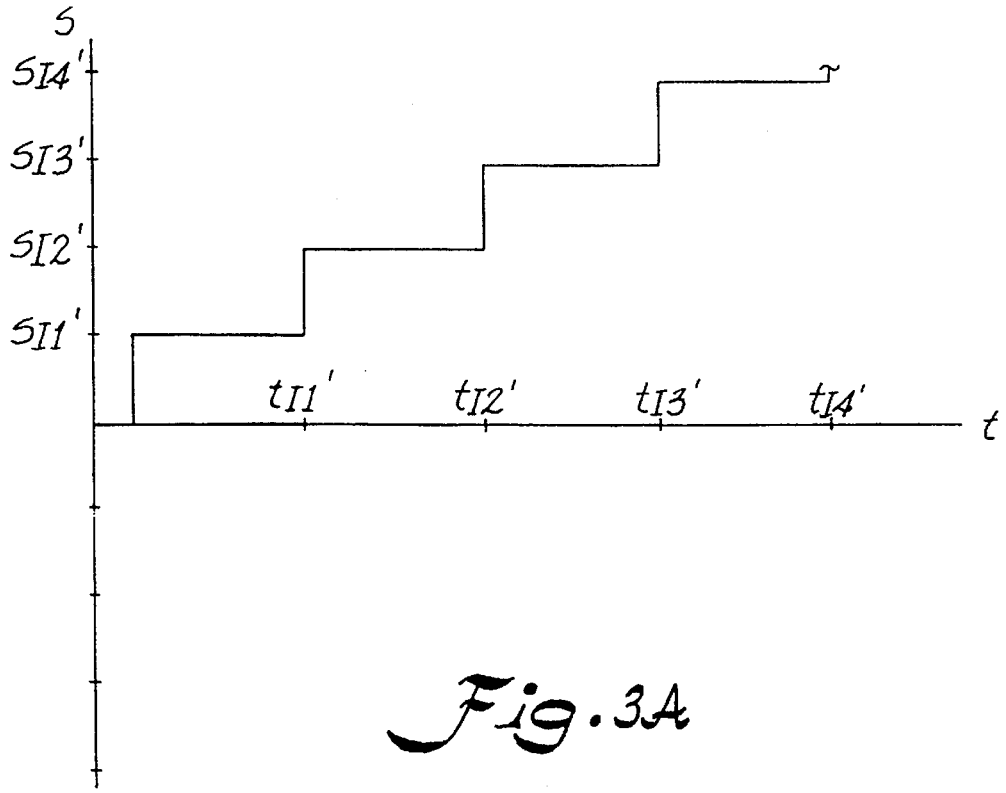
FIG. 3A is a diagram illustrating an exemplary inward speed variation responsive to deviation of a material edge from a normal operating path.
Figure 3B:
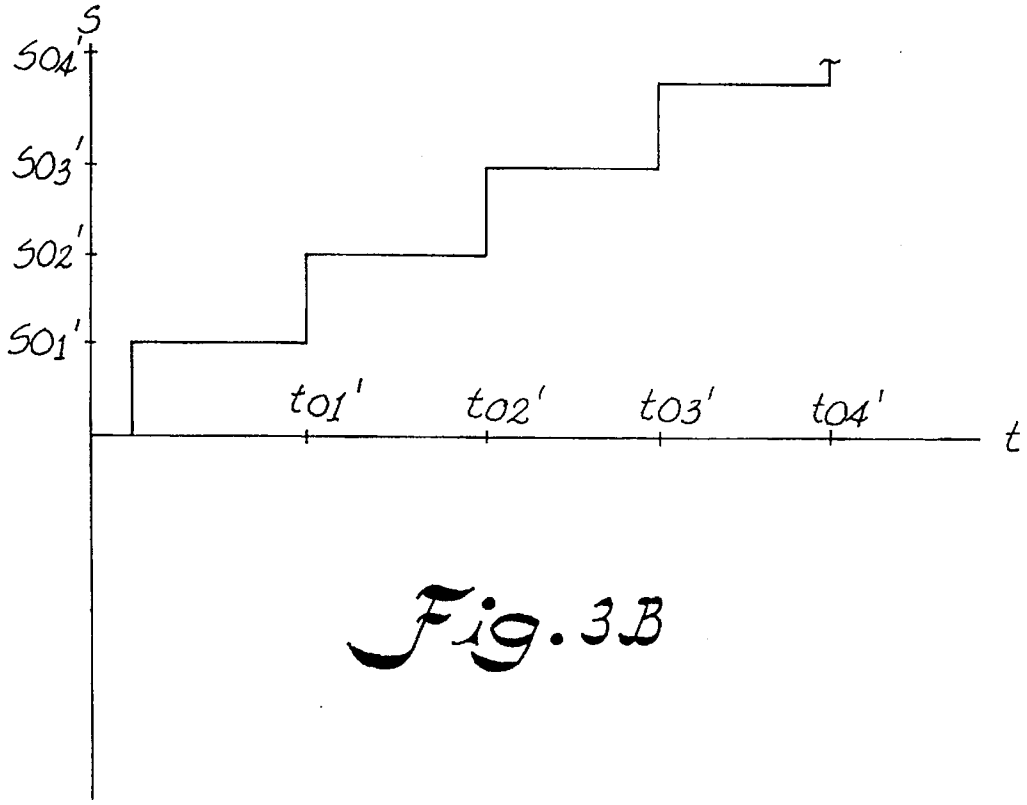
FIG. 3B is a diagram illustrating an exemplary outward speed variation responsive to deviation of a material edge from a normal operating path.

Referring now to FIGS. 3A and 3B, one exemplary illustration of such responsive speeds is provided. When $t_3$ expires at 88, predetermined outward and inward time periods $t_{XW}'$ are initialized at 94. Similarly, inward and outward speeds are initialized at 96. The state of the control photosensor is checked at 98 and speed is set accordingly at 100. For example, if fabric edge 24 extends outward from the normal operating path, speed S is set to $S_{01}'$. If fabric edge 24 extends inward from the normal operating path, speed S is set to $S_{I1}'$.

If fabric edge 24 does not cross normal operating line 60 within $t_{X1}'$($t_{01}$, if the frame member is moving outward; $t_{I1}$, if the frame member is moving inward), frame member 14 should move more quickly to pick up edge 24. Accordingly, if control photosensor 52 has not changed state at 102 before $t_{X1}'$ expires at 104, speed S is increased to $S_{X2}'$ at 106, $t_{X2}'$ is initialized at 108, and control photosensor 52 is checked again at 102. Frame speed $S_{XW}$, will be incremented to $S_{X3'}$ and $S_{X4'}$ at $t_{X3'}$ and $t_{X4'}$, respectively, if control photosensor 52 does not change state. A greater or lesser number of speed increments may be provided as appropriate for a particular system. If at any time during this process the fabric edge crosses normal operating line 60 (FIG. 5), photosensor 52 changes state and the normal operating path has been reachieved. At this point, $t_3$ is again initialized at 85 and the frame member is stopped at 86.

It should be understood that various speed variation configurations may be employed, for example including linear or geometric variations of speed with respect to time. Any and all such equivalent configurations are understood to be within the scope and spirit of the present invention.

If at any time during the process illustrated by FIG. 4 the emergency photosensor 54 becomes uncovered (that is, fabric edge 24 moves inward of emergency line 62), an emergency condition exists. Such gross inward deviations from the normal operating path may cause undesirable gaps as described above.

Accordingly, if emergency photosensor 54 is uncovered at 110, speed S is set to emergency inward speed SE at 112. Frame member 14 will be moved at speed SE until emergency photosensor 54 is covered at 114. The apparatus then begins at 66 to initiate the normal operating path. The emergency inward speed is proportional to the tenter frame speed. Applicant has found that a minimum adequate such emergency speed is 30 percent of the tenter frame speed. Of course, the speed may be set according to specific operating requirements.

It should be understood by those of ordinary skill in the art that the relation between emergency line 62 and normal operating line 60 may vary depending on particular operation conditions. For example, it may be desirable to employ an emergency photosensor outward of control photosensor 52.

While one preferred embodiment of the invention has been described above, it is to be understood that any and all equivalent realizations of the present invention are included within the scope and spirit thereof. For example, the longitudinal frame member may include various configurations and attachments to the main tenter frame body. Furthermore, although the embodiments discussed herein include pins on endless chains, it is understood that various means and methods, for example including clips, endless belts, and roller devices may be employed to move the fabric. All such equivalent moving means are encompassed by the present invention. Additionally, detector devices may include, for example photosensors, lasers, or air devices. Thus, the embodiments depicted are presented by way of example only and are not intended as limitations upon the present invention. Therefore, while particular embodiments of the invention have been described and shown, it will be understood by those of ordinary skill in this art that the present invention is not limited thereto since many modifications can be made. It is, therefore, contemplated that any and all such embodiments are included in the present invention as may fall within the literal or equivalent scope of the appended claims.

What is claimed is:

1. A method for handling a material of indeterminate length, comprising the steps of:

moving the material at least partially through a material handling apparatus along a path of travel;

detecting deviation of at least one edge of said material from a corresponding normal operating path; and effecting corrective reaction of said material handling apparatus, when said edge is determined to be outside its said normal operating path, at a predetermined rate, said predetermined rate varying in a predetermined pattern based upon time said edge remains out of its said normal operating path.

2. The method as in claim 11, wherein said detecting step includes recognizing lateral deviations of said edge from its said normal operating path when said edge fails to cross over a line within said normal operating path within a predetermined time period.

3. The method as in claim 1, wherein said detecting step includes detecting substantial deviation of said edge from its said normal operating path and wherein said effecting step includes effecting corrective reaction of said material handling apparatus at an emergency speed in response to said substantial deviation.

4. The method as in claim 1, wherein said moving step includes moving said material at least partially through said material handling apparatus by a pair of driven endless elements located on opposite sides of said intended path of travel, each said element at least partially received by a corresponding frame member longitudinally disposed and transversely adjustable with respect to said path of travel and having means thereon for engaging and holding a corresponding edge of said material, wherein said effecting step includes laterally adjusting a corresponding said frame member, wherein said detecting step includes detecting substantial deviation of said edge from its said normal operating path, and wherein said effecting step includes laterally adjusting said frame member in response to said substantial deviation at an emergency speed.

5. Apparatus for handling a moving material of indeterminate length, comprising:

a material moving mechanism for moving said material along a longitudinal path of travel with respect to said apparatus;

an adjustment device configured to laterally adjust said moving mechanism with respect to said edge of said material; and a detector assembly located adjacent a normal operating path of travel of said edge, said detector assembly configured to detect lateral deviation of said edge from said normal operating path and being operatively associated with said adjustment device to bring about adjustment of said moving mechanism relative to said edge of said material in reaction to deviation of said edge from said normal operating path, the rate of said adjustment being dependent upon time said edge remains out of said normal operating path.

6. The apparatus as in claim 5, wherein said moving mechanism includes an engaging mechanism for engaging said material adjacent said edge and wherein said detector assembly is configured to adjust the lateral position of said moving mechanism so that said engaging mechanism engages said material within a desired position adjacent said edge.

7. The apparatus as in claim 6, wherein said moving mechanism includes a frame member longitudinally disposed and transversely adjustable with respect to said path of travel for said moving material, and said engaging mechanism includes a driven endless element at least partially received by said frame member and having securing elements disposed thereon for engaging and holding said material during passage of said material at least partially through the apparatus.

8. The apparatus as in claim 7, wherein said detector assembly includes a detector housing disposed on said frame member upstream from said engaging elements so that said detector housing moves with said frame member when said frame member is adjusted by said adjustment device, said detector housing including a control detector disposed adjacent said normal operating path to detect deviations of said edge from said normal operating path so that said moving mechanism may be adjusted at said rate of adjustment.

9. The apparatus as in claim 8, wherein said detector housing includes an emergency detector sufficiently laterally offset from said control detector to detect substantial lateral deviation of said edge from said normal operating path, and wherein said detector assembly is configured to adjust the lateral position of said frame member at an emergency speed in reaction to said substantial deviation, said emergency speed being greater than said rate of adjustment.

10. The apparatus as in claim 9, wherein said detector assembly is configured to adjust said frame member at a predetermined speed from said emergency speed so that said securing elements engage said material within said desired position, the magnitude of said predetermined speed varying in a predetermined pattern and the direction of said predetermined speed being dependent upon the position of said edge with respect to said normal operating path.

11. The apparatus as in claim 7, wherein said detector assembly is configured to maintain lateral position of said frame member when said edge remains at its normal operating path.

12. The apparatus as in claim 1, wherein said detector assembly is configured to maintain position of said frame member when said edge varies over a line within said normal operating path within a predetermined time period.

13. The apparatus as in claim 7, wherein said detector assembly includes a microprocessor device for outputting corrective signals to said adjustment device to effect adjustment of said moving mechanism, and wherein said adjustment device includes a motive assembly for laterally moving said frame member, and a motor assembly in operative communication with said detector assembly and said motive assembly for driving said motive assembly responsively to said corrective signals.

14. The apparatus as in claim 13, wherein said adjustment device includes an interface device for presenting said signals received from said detector assembly to said motor device in a form actable upon by said motor device.

15. The apparatus as in claim 5, wherein said detector assembly is configured to adjust said moving means at a predetermined speed from a start-up condition, the magnitude of said predetermined speed varying in a predetermined pattern and the direction of said predetermined speed being dependent upon the position of said edge with respect to said normal operating path.

16. Apparatus for handling a moving material of indeterminate length, comprising:

a material moving mechanism for moving said material along a longitudinal path of travel with respect to said apparatus;

an adjustment device configured to laterally adjust said moving mechanism with respect to said edge of said material; and a detector assembly located adjacent a normal operating path of travel of said edge, said detector assembly configured to detect lateral deviation of said edge from said normal operating path and being operatively associated with said adjustment device to bring about adjustment of said moving mechanism relative to said edge of said material in reaction to deviation of said edge from said normal operating path, the rate of said adjustment being dependent upon time said edge remains out of said normal operating path and wherein said detector assembly is configured to recognize a lateral deviation of said edge from said normal operating path when said edge fails to cross over a line within said normal operating path within a predetermined time period.

17. The apparatus as in claim 16, wherein said moving mechanism includes a frame member longitudinally disposed and transversely adjustable with respect to said path of travel for said moving material, said frame member at least partially receiving a driven endless element having securing elements disposed thereon for engaging and holding said material during passage of said material at least partially through the apparatus, said detector housing is disposed on said frame member, upstream from said engaging elements, so that said detector housing moves with said frame member when said frame member is adjusted by said adjustment device, and said detector assembly is configured to adjust the lateral position of said frame member when said lateral deviation occurs so that said securing elements engage said material within a desired position adjacent said edge.

18. Apparatus for handling a moving material of indeterminate length, comprising:

a material moving mechanism for moving said material along a longitudinal path of travel with respect to the apparatus;

an adjustment device configured to laterally adjust said moving mechanism with respect to said edge of said material; and a detector assembly located adjacent a normal operating path of travel of said edge, said detector assembly including a detector housing including at least one control detector disposed adjacent said normal operating path to detect lateral deviations of said edge from said normal operating path and an emergency detector sufficiently laterally offset from said control detector to detect substantial lateral deviation of said edge from said normal operating path, wherein said detector assembly is operatively associated with said adjustment device to bring about adjustment of said moving mechanism relative to said edge of said material, in reaction to deviation of said edge less than said substantial deviation, at a rate dependent upon time said edge remains out of said normal operating path and to bring about adjustment of said moving mechanism relative to said edge of said material, in reaction to said substantial deviation, at an emergency speed, said emergency speed being greater than said rate of adjustment in reaction to deviation less than said substantial deviation.

19. The apparatus as in claim 18, wherein said emergency detector is disposed upstream from said control detector.

20. The apparatus as in claim 18, wherein said detector assembly is configured to adjust said moving mechanism at a predetermined speed from a start-up condition, the magnitude of said predetermined speed from said start-up condition varying in a predetermined pattern over a predetermined time period and the direction of said predetermined speed from said start-up condition being dependent upon the position of said edge with respect to said normal operating path.

21. A tenter frame for handling a moving material of indeterminate length, comprising:

a frame defining a longitudinal path of travel of said material;

a pair of frame members, each said frame member disposed on said frame on a respective side of, and generally parallel to, said path of travel and being pivotally mounted to said frame at a downstream end of said frame member so that said frame member may be adjusted laterally with respect to said path of travel;

a pair of driven endless elements, each said endless element being at least partially received by a respective said frame member and having securing elements disposed thereon for engaging and holding said material during passage of said material at least partially through the tenter frame;

a pair of adjustment devices, each said adjustment device operatively associated with a respective said frame member to adjust said frame member laterally with respect to said path of travel; and a pair of detector assemblies, each said detector assembly including a detector housing disposed on a respective said frame member, so that said detector housing moves with said frame member, upstream from said securing elements and adjacent a normal operating path of travel a said edge, said detector housing including a control detector configured to detect lateral deviation of said edge from said normal operating path and an emergency detector upstream from said control detector and sufficiently laterally offset therefrom to detect substantial lateral deviation of said edge from said normal operating path, each said detector assembly being operatively associated with a respective said adjustment device to bring about adjustment of the lateral position of said frame member in reaction to deviation of said edge less than said substantial deviation at a rate dependent upon time said edge remains out of said normal operating path, and to bring about adjustment of the lateral position of said frame member in reaction to said substantial deviation of said edge from said normal operating path of said edge at an emergency speed, said emergency speed being greater than said rate of adjustment in reaction to deviation less than said substantial deviation, so that said securing elements engage said material within a desired position adjacent said edge.

22. The tenter frame as in claim 21, wherein each said detector assembly is configured to recognize a lateral deviation of its respective said edge from its normal operating path when said control detector fails to detect the crossing of said edge over a line within said normal operating path within a predetermined time period.

23. The tenter frame as in claim 21, wherein each said detector assembly is configured to bring about adjustment of the lateral position of its respective said frame member, in reaction to said substantial deviation of said edge from said normal operating path, at said emergency speed and, when said emergency detector no longer detects a substantial deviation, at a predetermined speed from said emergency speed, the magnitude of said predetermined speed varying in a predetermined pattern over a predetermined time period and the direction of said predetermined speed being dependent upon the position of said edge with respect to said normal operating path.

24. A control mechanism for use with an apparatus for handling a material of indeterminate length moving in a longitudinal path of travel with respect to said apparatus, the mechanism comprising a detector assembly configured to be disposed adjacent said path of travel for monitoring an edge of said moving material, said detector assembly being adapted to initiate corrective reaction of said material handling apparatus when said edge is determined to be outside a normal operating path and to control said corrective reaction such that the rate of said corrective reaction is dependent upon time said edge remains out of said normal operating path, said rate varying in a predetermined pattern based upon time lapsed from initiation of said corrective reaction.

* * * * *